US010371083B2

(12) United States Patent
Douglas

(10) Patent No.: US 10,371,083 B2
(45) Date of Patent: Aug. 6, 2019

(54) SYSTEMS AND METHODS FOR FUEL CONTROL DURING COLD STARTS

(71) Applicant: GM GLOBAL TECHNOLOGY OPERATIONS LLC, Detroit, MI (US)

(72) Inventor: Scot A. Douglas, Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1524 days.

(21) Appl. No.: 13/713,446

(22) Filed: Dec. 13, 2012

(65) Prior Publication Data

US 2014/0172274 A1 Jun. 19, 2014

(51) Int. Cl.

| | |
|---|---|
| ***F02D 41/30*** | (2006.01) |
| ***F02D 41/06*** | (2006.01) |
| ***F02D 41/00*** | (2006.01) |
| *F02D 41/40* | (2006.01) |

(52) U.S. Cl.

CPC ..... *F02D 41/3076* (2013.01); *F02D 41/0027* (2013.01); *F02D 41/064* (2013.01); *F02D 41/402* (2013.01)

(58) Field of Classification Search

CPC ..... F02N 11/0829; F02N 2010/002; F02N 19/02; F02N 99/006; F02N 2200/023; F02N 2300/2002; F02D 19/105; F02D 33/006; F02D 41/06; F02D 41/062; F02D 41/064

See application file for complete search history.

(56) References Cited

U.S. PATENT DOCUMENTS

| | | | | |
|---|---|---|---|---|
| 5,231,962 | A * | 8/1993 | Osuka et al. | 123/299 |
| 5,924,405 | A * | 7/1999 | Hashimoto | 123/431 |
| 6,244,247 | B1 * | 6/2001 | Matsubara et al. | 123/305 |
| 7,841,316 | B2 | 11/2010 | Inoue | |
| 9,163,568 | B2 | 10/2015 | Sczomak et al. | |
| 2003/0034012 | A1 * | 2/2003 | Sato et al. | 123/491 |
| 2004/0173165 | A1 * | 9/2004 | Sieber et al. | 123/3 |
| 2009/0018755 | A1 * | 1/2009 | Inoue | 701/103 |

(Continued)

FOREIGN PATENT DOCUMENTS

| | | | |
|---|---|---|---|
| CN | 101344046 | A | 1/2009 |
| CN | 102042102 | A | 5/2011 |

(Continued)

OTHER PUBLICATIONS

First Office Action for German Application No. 10 2013 113 750.4 dated Feb. 7, 2018; 5 pages.

*Primary Examiner* — Erick Solis
*Assistant Examiner* — Anthony L Bacon

(57) ABSTRACT

A cold start control system for a vehicle having a spark ignition direct injection (SIDI) engine includes a startup control module and a fuel actuator module. The startup control module sets a mode of operation to a cold start mode. In response to setting the mode to the cold start mode, the startup control module determines target combustion parameters and a predetermined amount of fuel, wherein the predetermined amount of fuel is less than an amount of fuel required to initiate a combustion stroke of the SIDI engine. The startup control module controls injection of the predetermined amount of fuel, during cranking of the SIDI engine, based on the target combustion parameters. The fuel actuator module injects the predetermined amount of fuel, during cranking, based on the target combustion parameters.

18 Claims, 3 Drawing Sheets

(56) References Cited

U.S. PATENT DOCUMENTS

| | | | | |
|---|---|---|---|---|
| 2009/0120396 | A1* | 5/2009 | Krenus et al. | 123/179.16 |
| 2010/0294236 | A1* | 11/2010 | Surnilla et al. | 123/304 |
| 2011/0088661 | A1 | 4/2011 | Sczomak et al. | |
| 2011/0184629 | A1* | 7/2011 | Krengel et al. | 701/103 |

FOREIGN PATENT DOCUMENTS

| | | | |
|---|---|---|---|
| DE | 102008002619 | A1 | 1/2009 |
| DE | 102013113750 | A1 | 6/2014 |

* cited by examiner

SYSTEMS AND METHODS FOR FUEL CONTROL DURING COLD STARTS

FIELD

The present disclosure relates to internal combustion engines and more particularly to engine control systems and methods for cold engine startups.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion (IC) engines combust air and fuel within cylinders to produce drive torque. Air flow into an engine may be regulated via a throttle valve. A fuel control system controls fuel injection amount and timing. Increasing the amount of air and fuel provided to the cylinders generally increases the torque output of the engine.

Spark ignition direct injection (SIDI) systems are currently used by many engine manufacturers. SIDI refers to direct injection of highly pressurized fuel into cylinders of a spark-ignited gasoline engine. SIDI allows for improved control of fuel injection timing. A fuel system of an SIDI engine may include a low-pressure fuel pump and a high-pressure fuel pump. The low-pressure fuel pump pumps fuel from a fuel tank to a low-pressure fuel line. The high-pressure fuel pump, which is mechanically driven by the engine, pumps fuel from the low-pressure fuel line to a high-pressure fuel line and/or fuel rail. Fuel injectors of the SIDI engine receive fuel from the fuel rail and inject fuel directly into cylinders of the SIDI engine.

In an SIDI engine, fuel may be directly injected into cylinders of the SIDI engine at various times during a combustion cycle. This is unlike port-fuel-injected engines where fuel is injected, for example, into a port and/or intake manifold of an engine and before an intake stroke of a corresponding combustion cycle. The increased control that may be associated with an SIDI engine provides increased horsepower, reduced emissions, and knock suppression. The stratified fuel charge allows for a lean burn and improves fuel efficiency.

SUMMARY

A cold start control system for a vehicle having a spark ignition direct injection (SIDI) engine includes a startup control module and a fuel actuator module. The startup control module sets a mode of operation to a cold start mode. In response to setting the mode to the cold start mode, the startup control module determines target combustion parameters and a predetermined amount of fuel, wherein the predetermined amount of fuel is less than an amount of fuel required to initiate a combustion stroke of the SIDI engine. The startup control module controls injection of the predetermined amount of fuel, during cranking of the SIDI engine, based on the target combustion parameters. The fuel actuator module injects the predetermined amount of fuel, during cranking, based on the target combustion parameters.

A cold start control method for a vehicle having a spark ignition direct injection (SIDI) engine includes: setting a mode of operation to a cold start mode and determining target combustion parameters and a predetermined amount of fuel in response to the setting of the mode to the cold start mode. The predetermined amount of fuel is less than an amount of fuel required to initiate a combustion stroke of the SIDI engine. The cold start control method further includes: controlling injection of the predetermined amount of fuel during cranking of the SIDI engine based on the target combustion parameters and injecting the predetermined amount of fuel during cranking of the SIDI engine based on the target combustion parameters.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
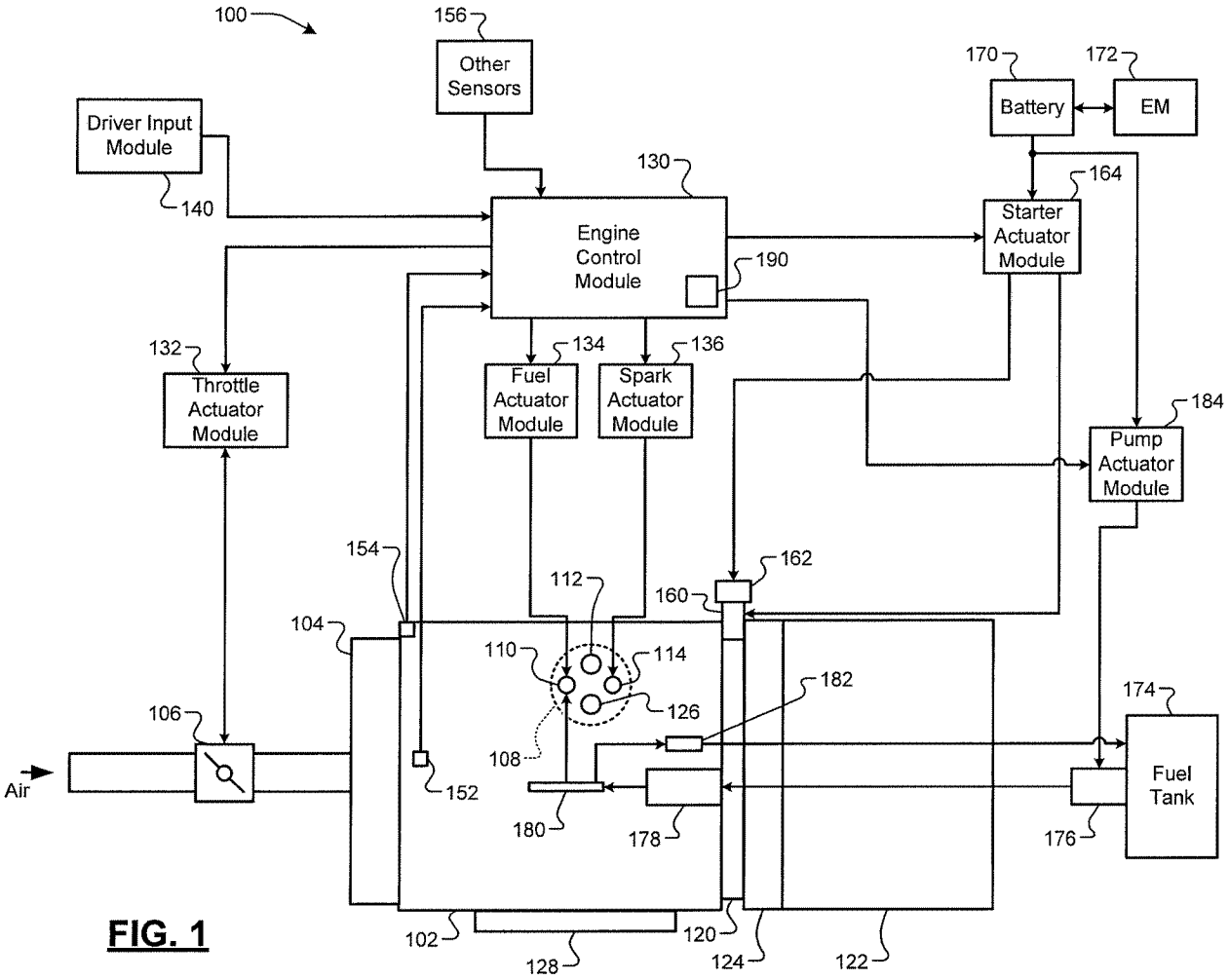
FIG. 1 is a functional block diagram of an example spark ignition direct injection (SIDI) engine system according to the present disclosure.

A spark ignition direct injection (SIDI) engine combusts air and fuel to generate drive torque for a vehicle. Fuel injectors of the SIDI engine receive fuel at a high-pressure from the fuel rail. The fuel is injected directly into cylinders of SIDI engines. The fuel may be gasoline, a mixture of gasoline and ethanol, a mixture of methanol and ethanol, or another suitable type of fuel.

A control module selectively starts an SIDI engine in response to user actuation of an ignition input, such as an ignition key or button, or initiation of an auto-start event. The control module controls various operating parameters during startup of the SIDI engine and while the SIDI engine is ON (running) after startup. For example, the control module controls opening of a throttle valve, fuel injection amount and timing, spark timing, and other suitable operating parameters during startup of the SIDI engine and while the SIDI engine is ON after startup. The control module also selectively shuts down the SIDI engine in response to user actuation of an ignition input or initiation of an auto-stop event.

Different types of fuel have different flash point temperatures. For example, ethanol has a higher flash point temperature than gasoline. The flash point temperature of a fuel may refer to a minimum temperature at which the fuel can vaporize to form an ignitable mixture in air. At temperatures that are less than the flash point temperature, the fuel may be unable to vaporize during startup, and the SIDI engine may be unable to start.

One or more auxiliary devices may be used to facilitate startup of the SIDI engine at temperatures that are less than the flash point temperature of the fuel. For example, a block heater and/or a fuel rail heater or a fuel injector heater may be added to warm the fuel. Warming the fuel may enable the fuel to vaporize sufficiently to allow startup of the SIDI engine at temperatures that are less than the flash point temperature of the fuel. For another example, as gasoline has a low flash point temperature relative to other types of fuels, a separate gasoline tank and a gasoline injector can be added for use during startup of engines using a fuel having a high flash point temperature, such as ethanol. Adding one or more auxiliary devices, however, increases vehicle cost.

In a system according to the present disclosure, at temperatures that are at or less than the flash point temperature of the fuel that is directly injected into the cylinders of the SIDI engine, the control module according to the present disclosure selectively controls injections of small amounts of fuel, at high pressure, that are enough to warm the cylinder without igniting an entire fuel charge. The fuel is injected on or near a spark plug of a cylinder, timed to occur during a multi-strike ignition event during engine cranking, to warm the cylinder, promote vaporization, and ignite the rest of an intake charge of fuel, enabling startup of the SIDI engine without the use of auxiliary devices.

Referring now to FIG. 1, a functional block diagram of an example engine system 100 is presented. The engine system 100 includes an engine 102 that combusts an air/fuel mixture to produce drive torque for a vehicle. Air is drawn into an intake manifold 104 through a throttle valve 106. The throttle valve 106 regulates air flow into the intake manifold 104. Air within the intake manifold 104 is drawn into cylinders of the engine 102, such as cylinder 108.

One or more fuel injectors, such as fuel injector 110, inject fuel that mixes with air to form an air/fuel mixture. In various implementations, one fuel injector may be provided for each cylinder of the engine 102. The fuel injectors inject fuel directly into the cylinders. Fuel injection may be controlled based on a desired air/fuel mixture for combustion, such as a stoichiometric air/fuel mixture, or a lean air/fuel mixture, which contains less fuel than a stoichiometric air/fuel mixture. A fuel system provides fuel to the fuel injectors. The fuel system is discussed further below.

An intake valve 112 opens to allow air into the cylinder 108. A piston (not shown) compresses the air/fuel mixture within the cylinder 108. A spark plug 114 initiates combustion of the air/fuel mixture within the cylinder 108. One spark plug may be provided for each cylinder of the engine 102. Combustion of the air/fuel mixture applies force to the piston, and the piston drives rotation of a crankshaft (not shown).

The engine 102 outputs torque via the crankshaft. A flywheel 120 is coupled to the crankshaft and rotates with the crankshaft. Torque output by the engine 102 is selectively transferred to a transmission 122 via a torque transfer device 124. The torque transfer device 124 selectively couples/decouples the transmission 122 to/from the engine 102. The transmission 122 may include, for example, a manual transmission, an automatic transmission, a semi-automatic transmission, an auto-manual transmission, or another suitable type of transmission. The torque transfer device 124 may include, for example, a torque converter and/or one or more clutches.

Exhaust produced by combustion of the air/fuel mixture is expelled from the cylinder 108 via an exhaust valve 126. The exhaust is expelled from the cylinders to an exhaust system 128. The exhaust system 128 may treat the exhaust before the exhaust is expelled from the exhaust system 128. Although one intake and exhaust valve are shown and described as being associated with the cylinder 108, more than one intake and/or exhaust valve may be associated with each cylinder of the engine 102.

An engine control module (ECM) 130 controls various engine actuators. The engine actuators may include, for example, a throttle actuator module 132, a fuel actuator module 134, and a spark actuator module 136. The engine system 100 may also include other engine actuators, and the ECM 130 may control the other engine actuators.

Each engine actuator controls an operating parameter based on a signal from the ECM 130. For example only, based on signals from the ECM 130, the throttle actuator module 132 may control opening of the throttle valve 106, the fuel actuator module 134 may control fuel injection amount and timing, and the spark actuator module 136 may control spark timing.

The ECM 130 may control the engine actuators based on, for example, driver inputs and inputs from various vehicle systems. The vehicle systems may include, for example, a transmission system, a hybrid control system, a stability control system, a chassis control system, and other suitable vehicle systems.

A driver input module 140 may provide the driver inputs to the ECM 130. The driver inputs provided to the ECM 130 may include, for example, an accelerator pedal position (APP), a brake pedal position (BPP), cruise control inputs, and vehicle operation commands. The vehicle operation commands may include, for example, vehicle startup commands and vehicle shutdown commands. The vehicle operation commands may be input by a user via actuation of one or more ignition system inputs. For example, a user may input the vehicle operation commands by actuating an ignition key, one or more buttons/switches, and/or one or more other suitable ignition system inputs.

An engine speed sensor 152 measures rotational speed of the engine 102 and generates an engine speed based on the speed. For example only, the engine speed sensor 152 may generate the engine speed based on rotation of the crankshaft in revolutions per minute (rpm). A coolant temperature sensor 154 measures a temperature of engine coolant and generates an engine coolant temperature (ECT) based on the temperature of the engine coolant. The ECM 130 may also receive operating parameters measured by other sensors 156, such as oxygen in the exhaust, intake air temperature (IAT), mass air flowrate (MAF), oil temperature, manifold absolute pressure (MAP), and/or other suitable parameters. In various implementations, ethanol content may be measured using a sensor.

The ECM 130 selectively shuts down the engine 102 when a user inputs a vehicle shutdown command. For example only, the ECM 130 may disable the injection of fuel, disable the provision of spark, and perform other shutdown operations to shut down the engine 102 in response to receipt of a vehicle shutdown command.

The ECM 130 selectively starts the engine 102. The ECM 130 starts the engine 102 in response to receipt of a vehicle-startup command or initiation of an auto-start event. The ECM 130 engages a starter motor 160 with the engine 102 to initiate engine startup. The starter motor 160 may engage the flywheel 120 or other suitable components that drive rotation of the crankshaft.

A starter motor actuator 162, such as a solenoid, selectively engages the starter motor 160 with the engine 102. A starter actuator module 164 controls the starter motor actuator 162 and the starter motor 160 based on signals from the ECM 130. For example only, the ECM 130 may command engagement of the starter motor 160 when the vehicle-startup command is received. The starter actuator module 164 selectively applies current to the starter motor 160 when the starter motor 160 is engaged with the engine 102. The application of current to the starter motor 160 drives the starter motor 160, and the starter motor 160 drives the crankshaft.

Once the crankshaft is rotating, the starter motor 160 may be disengaged from the engine 102, and the flow of current to the starter motor 160 may be discontinued. The engine 102 may be deemed running, for example, when the engine speed exceeds a predetermined speed, such as approximately 700 rpm or another suitable speed. The period between when the starter motor 160 is engaged with the engine 102 for starting the engine and when the engine 102 is deemed running may be referred to as engine cranking.

The current provided to the starter motor 160 may be provided by, for example, a battery 170. While only the battery 170 is shown, the battery 170 may include one or more individual batteries that are connected together or one or more other batteries may be provided.

The engine system 100 may include one or more electric motors, such as electric motor (EM) 172. The EM 172 may selectively draw electrical power, for example, to supplement the torque output of the engine 102. The EM 172 may also selectively function as a generator and selectively apply a braking torque to the engine 102 to generate electrical power. Generated electrical power may be used, for example, to charge the battery 170, to provide electrical power to one or more other EMs (not shown), to provide electrical power to other vehicle systems, and/or for other suitable uses.

As mentioned above, the fuel system supplies fuel to the fuel injectors. The fuel system may include a fuel tank 174, a low pressure fuel pump 176, a high pressure fuel pump 178, a fuel rail 180, a pressure relief valve 182, and/or one or more other suitable components. The low pressure fuel pump 176 draws fuel from the fuel tank 174 and provides fuel at low pressures to the high pressure fuel pump 178. The low pressures provided by the low pressure fuel pump 176 are expressed relative to pressurization provided by the high pressure fuel pump 178.

The low pressure fuel pump 176 is an electrically driven fuel pump. A pump actuator module 184 may control the application of power to the low pressure fuel pump 176 based on signals from the ECM 130. For example only, the ECM 130 may command application of power to the low pressure fuel pump 176 when or before a vehicle-startup command is input.

The high pressure fuel pump 178 pressurizes the fuel received from the low pressure fuel pump 176 within the fuel rail 180. The high pressure fuel pump 178 is engine driven, such as by the crankshaft or by a camshaft. The high pressure fuel pump 178 may pump fuel into the fuel rail 180, for example, once, twice, or more per revolution of the crankshaft.

The fuel injectors inject fuel from the fuel rail 180 into the cylinders. The high pressure fuel pump 178 pressurizes the fuel within the fuel rail 180 to pressures that are greater than pressure within the cylinder during fuel injection. When a pressure within the fuel rail 180 is greater than a predetermined maximum pressure, the pressure relief valve 182 releases fuel back to the fuel tank 174.

Fuel is injected directly into the cylinders and combustion is initiated via spark. In other words, the engine 102 may be referred to as a spark ignition direct injection (SIDI) engine. Flex fuel SIDI engines can combust gasoline, a blend of gasoline and ethanol, or ethanol. An ethanol fuel may be referred to using the prefix E and an integer corresponding to an amount of ethanol in the blend by volume. For example, E85 may refer to a blend of gasoline and ethanol that includes 85 percent ethanol by volume, E50 may refer to a blend of gasoline and ethanol that includes up to 50 percent ethanol by volume, etc. Ethanol may be referred to as E100, and gasoline may be referred to as E0. Other types of fuels that may be combusted by SIDI engines include methanol, other alcohol based fuels, liquefied petroleum gas (LPG), propane, butane, etc.

Flash point temperature of a fuel may refer to a minimum temperature at which the fuel can vaporize to form an ignitable mixture in air. Some fuels, such as gasoline, have a flash point temperature that is less than a predetermined minimum temperature, such as −10 degrees Celsius (° C.). Other fuels, however, have a flash point temperature that is greater than the predetermined minimum temperature. For example only, E100 may have a flash point temperature of approximately 18° C. Fuels having a flash point temperature that is greater than the predetermined minimum temperature may be unable to vaporize and/or combust when the engine 102 is started at or even above the predetermined minimum temperature.

At temperatures that are less than the flash point temperature of the fuel within the fuel tank 174, a startup control module 190 of the ECM 130 selectively controls injections of small amounts of fuel that warm the cylinder but are insufficient to ignite the fuel charge. The fuel is injected at high pressure on or near the spark plug 114 of the cylinder 108, for example, timed to occur during a multi-strike ignition event, to warm the cylinder 108 to enable vaporization and combustion of an intake charge of fuel.

Figure 2:
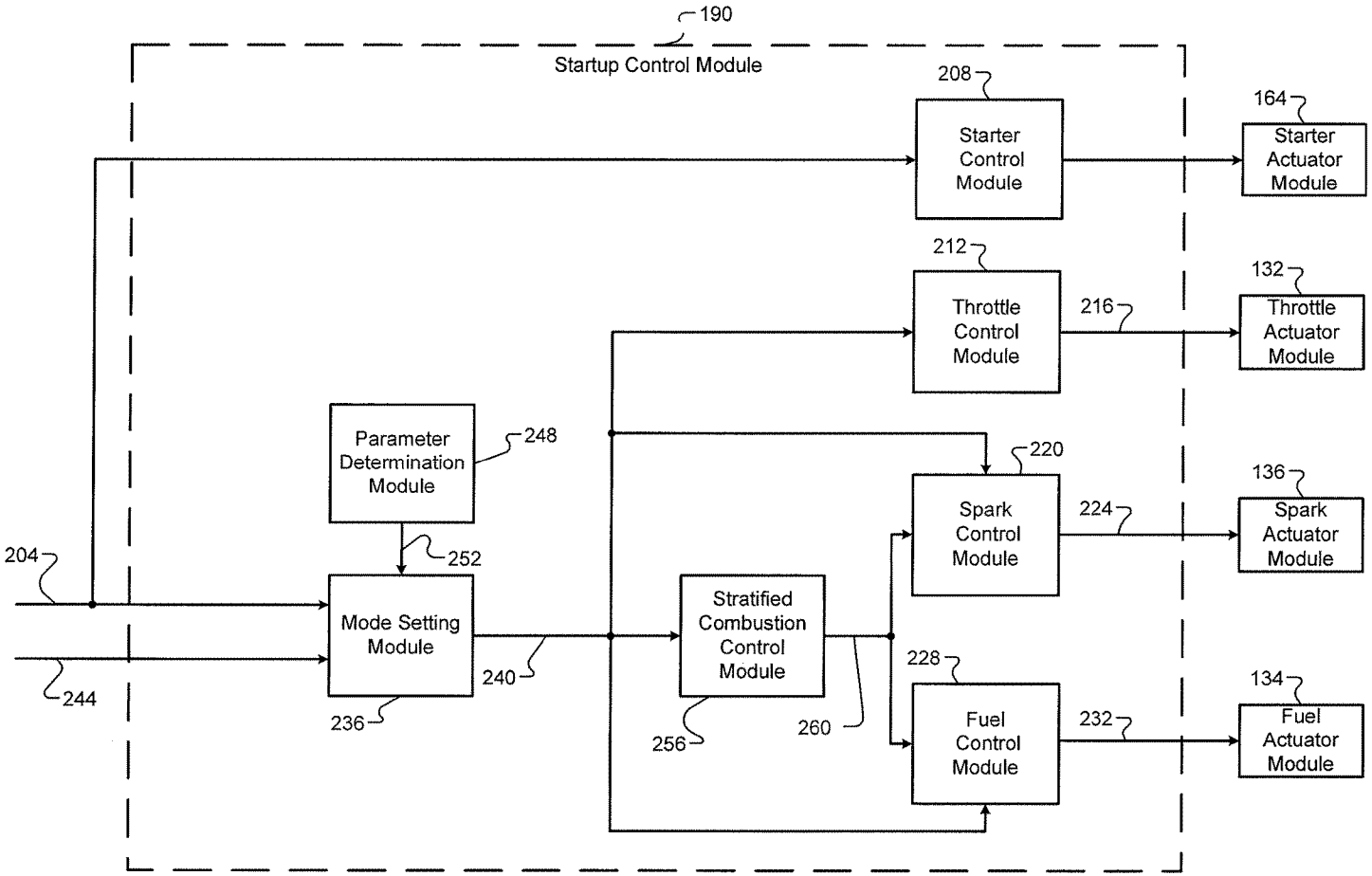
FIG. 2 is a functional block diagram of an example startup control module according to the present disclosure.

Referring now to FIG. 2, a functional block diagram of an example startup control module 200 is presented. In response to a user inputting a vehicle-startup command 204 while the engine 102 is off, a starter control module 208 commands the starter actuator module 164 to engage the starter motor 160 with the engine 102 and apply power to the starter motor 160 as shown in FIG. 1. The vehicle-startup command 204 may be input by the driver, for example, by actuating one or more ignition inputs.

The starter actuator module 164 engages the starter motor 160 with the engine 102 and applies power to the starter motor 160 in response to the command. When engaged with the engine 102 and receiving power, the starter motor 160 drives rotation of the crankshaft. Power is also applied to the low pressure fuel pump 176 during engine cranking. Power may be applied to the low pressure fuel pump 176 before power is applied to the starter motor 160. The low pressure fuel pump 176 may be controlled during engine cranking and while the engine 102 is running by providing fuel to the high pressure fuel pump 178 at a predetermined low pressure. The high pressure fuel pump 178 increases the pressure of the fuel within the fuel rail 180 as the starter motor 160 drives the crankshaft.

A throttle control module 212 controls opening of the throttle valve 106. The throttle control module 212 may set a desired area 216 for the throttle valve 106, and the throttle actuator module 132 may actuate the throttle valve 106 based on the desired area 216. A spark control module 220 may set a desired spark timing 224, and the spark actuator module 136 may generate spark based on the desired spark timing 224. A fuel control module 228 controls amount and timing of fuel injection. The fuel control module 228 may set target fueling parameters 232 (e.g., target amount, target timing, target number of pulses, etc.), and the fuel actuator module 134 may control the fuel injectors based on the target fueling parameters 232.

A mode setting module 236 sets a mode 240 of operation for the engine 102. The mode setting module 236 may set the mode 240 to a cold start mode in response to the vehicle startup command 204 and a determination that a temperature is less than a predetermined temperature. For example, the mode setting module 236 may set the mode 240 to the cold start mode when an ECT (engine coolant temperature) 244 is less than the predetermined temperature. The predetermined temperature is less than or equal to the flash point temperature of the fuel within the fuel tank 174. The predetermined temperature may be any temperature below which the fuel within the fuel tank 174 may be unable to vaporize during engine cranking. When the temperature is not less than the predetermined temperature, the mode setting module 236 may set the mode 240 to a normal start mode for a normal engine startup.

A parameter determination module 248 determines a characteristic 252 of the fuel within the fuel tank 174. For example only, the parameter determination module 248 may determine a percentage of ethanol in the fuel within the fuel tank 174. The parameter determination module 248 may determine the characteristic 252 of the fuel within the fuel tank 174, for example, based on measurements provided by a fuel characteristic sensor, cylinder pressures, and/or other suitable parameters.

The mode setting module 236 may set the predetermined temperature (used for determining whether to set the mode 240 to the cold start mode) based on the characteristic 252. For example only, the mode setting module 236 may set the predetermined temperature using a function or a mapping (e.g., lookup table) that relates the characteristic 252 of the fuel within the fuel tank 174 to the predetermined temperature.

Small amounts of fuel are injected on or near the spark plug while it is firing. The fuel is ignited. The force of this combustion is not enough to initiate a combustion stroke of the SIDI engine 102. This combustion produces heat. The heat assists the electric starter motor 160 during cranking and warms the cylinder. Warming the cylinder allows the rest of an intake charge of fuel to vaporize and ignite, enabling startup of the SIDI engine 102. Though the intake charge of fuel may be lean (less than stoichiometric), the small amounts of fuel on or near the spark plug are at or near stoichiometric. Accordingly, the small amounts of fuel are more likely to combust. The spark plug may fire multiple times to increase the chance of igniting the small amounts of fuel. The force produced by the combustion of the small amounts of fuel is not sufficient to compress the piston. Accordingly, heat is generated without moving the piston, and the temperature inside the cylinder increases. The heat produced is sufficient to warm the cylinder and encourage vaporization and ignition of a lean air/fuel mixture. However, the heat produced is not sufficient to vaporize and ignite the intake charge of fuel, which would rapidly cool the cylinder 108 and prevent further vaporization.

A stratified combustion control module 256 may determine target combustion parameters 260 (e.g., target fuel amount, spark timing, distribution of injection events, end of injection (EOI), start of ignition (SOI), etc.) based on the mode 240. When the mode 240 is set to the cold start mode, the stratified combustion control module 256 may set the target combustion parameters 260 using lookup tables that are based on experimental data.

The stratified combustion control module 256 may set a target crank angle that defines an end of injection (EOI) that allows injection and ignition to overlap by a number of events. The EOI is a crank angle that defines the end of injection. The stratified combustion control module 256 may determine a start of ignition (SOI). The start of ignition is a crank angle that defines the start of ignition. The stratified combustion control module 256 may set the EOI using a lookup table. The stratified combustion control module 256 may set the number of ignition events during the overlap based on cranking RPM and engine coolant temperature. The amount of fuel injected per event during the overlap may be determined based on a multiplier of the target amount of fuel for a cold start without stratified combustion and the number of events.

The stratified combustion control module 256 may set the target combustion parameters 260 such that the start of ignition occurs before the end of injection. For example, the stratified combustion control module 256 may set the target combustion parameters 260 such that small amounts of fuel are injected just before or just as the spark plug fires. For example, the stratified combustion control module 256 may set the target combustion parameters 260 such that small amounts of fuel are injected just before the piston gets to its top dead center position and the fuel ignites.

The throttle control module 212 may control the throttle valve 106 based on the mode 240. The spark control module 220 may control the spark timing based on the mode 240. When the mode 240 is set to the cold start mode, the spark control module 220 may adjust the target spark timing 224 during engine cranking based on the target combustion parameters 260. The fuel control module 228 may control the fueling based on the mode 240. When the mode 240 is set to the cold start mode, the fuel control module 228 may adjust the fueling parameters 232 and control fuel injection during engine cranking based on the target combustion parameters 260. One or more other engine actuators may also be controlled based on the mode 240.

The mode setting module 236 may transition the mode 240 from the cold start mode (or the start mode) to an engine running mode when the engine is running after a startup. The mode setting module 236 may transition the mode 240 to the engine running mode, for example, when an engine speed becomes greater than a predetermined speed, such as approximately 700 rpm or another suitable speed. The throttle control module 212, the fuel control module 228, and the spark control module 220 may transition to normal control of the throttle valve 112, fueling, and spark timing, respectively, in response to a transition in the mode 240 to the engine running mode.

Figure 3:
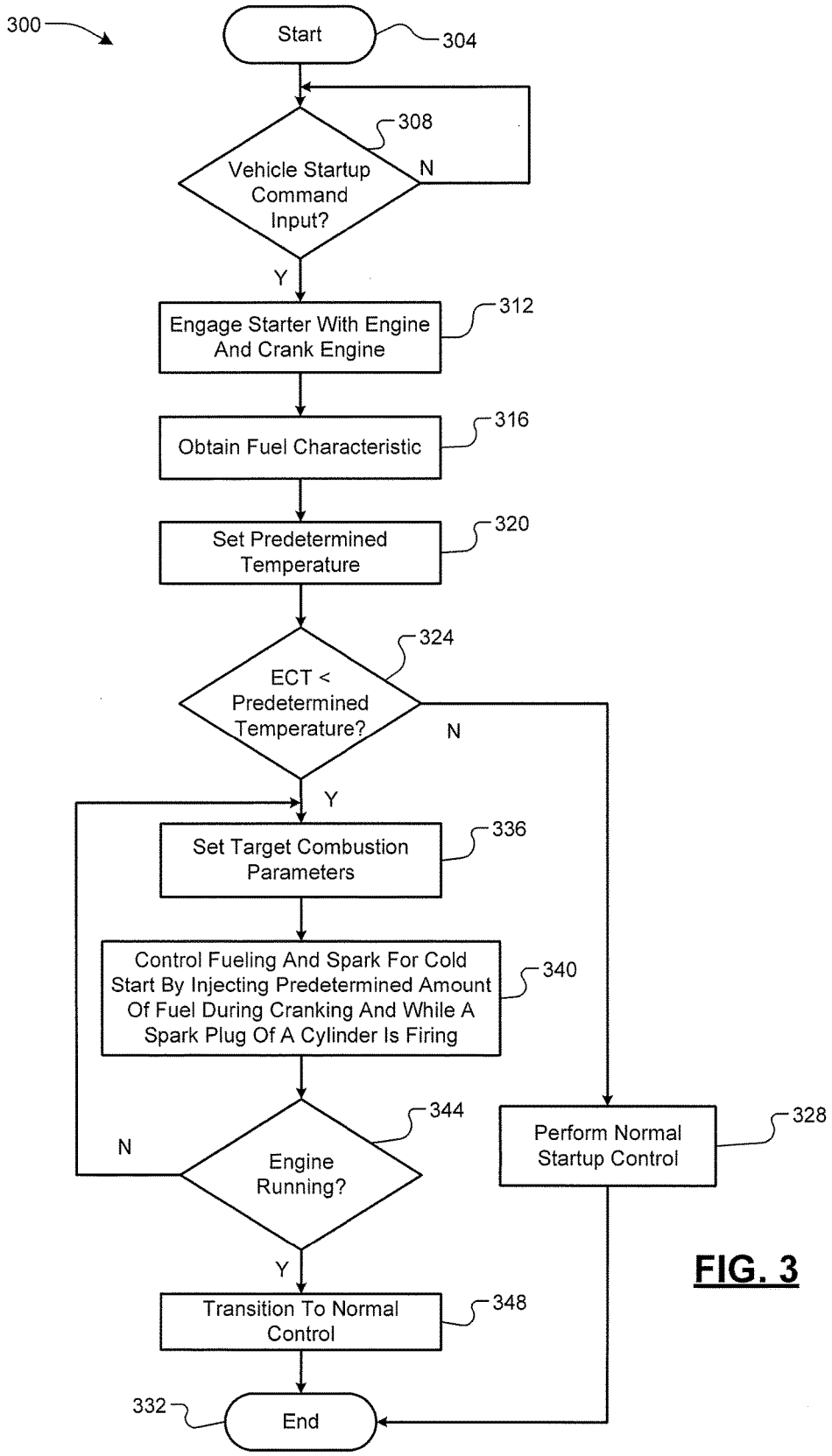
FIG. 3 is a flowchart depicting an example method of performing a cold start of an SIDI engine according to the present disclosure.

Referring now to FIG. 3, a flowchart depicting an example method 300 of performing a cold start of the engine 102 is presented. Control may begin at 304 at a time when the engine 102 is off. The engine 102 may be off, for example, pursuant to a previous vehicle shutdown request. At 308, control determines whether a user has input a vehicle startup command 204. If false, control remains at 308 and waits for a user to input a vehicle startup command 204. If true, control continues at 312. A user may input a vehicle startup command 204 by actuating an ignition switch, an ignition button, a remote-start button, etc.

At 312, control engages the starter motor 160 with the engine 102 and applies power to the starter motor 160. The starter motor 160 drives rotation of the crankshaft of the engine 102. The low pressure fuel pump 176 may be activated to begin pumping fuel to the high pressure fuel pump 178 before the starter motor 160 begins driving the crankshaft. The high pressure fuel pump 178 pumps fuel into the fuel rail 180 as the starter motor 160 drives the crankshaft.

At 316, control obtains a characteristic of the fuel within the fuel tank 174. The characteristic of the fuel may be, for example, an ethanol concentration of the fuel, a flash point temperature of the fuel, or another suitable characteristic of the fuel. At 320, control may set the predetermined temperature used in determining whether the startup of the engine 102 is a cold start based on the characteristic of the fuel. The predetermined temperature is less than or equal to the flash point temperature of the fuel.

At 324, control may determine whether the ECT 244 is less than the predetermined temperature. If false, control may perform a normal startup of the engine 102 at 328, and control may end at 332. If true, control may continue with 336 and perform a cold start of the engine 102.

At 336, control may set the target combustion parameters 260. Control may set the target combustion parameters 260 using lookup tables that are based on experimental data. For example, control may command multiple injections of fuel during engine cranking. For another example, control may adjust the amount of fuel injected. For still another example, control may adjust spark timing.

At 340, control regulates fuel injection and spark timing for the cold start of the engine 102 based on the target combustion parameters 260.

At 344, control may determine whether the engine 102 is running. If true, control may transition to a normal operation mode at 348, and control may end at 332. If false, control may return to 336 and continue controlling fueling and spark for the cold start of the engine 102. The engine 102 may be deemed running, for example, when the engine speed is greater than the predetermined speed.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A cold start control system for a vehicle having a spark ignition direct injection (SIDI) engine, comprising:

a startup control module that sets a mode of operation to a cold start mode;

in response to the setting of the mode to the cold start mode, determines target combustion parameters and a predetermined amount of fuel, wherein the predetermined amount of fuel is less than an amount of fuel required to initiate a combustion stroke of the SIDI engine; and controls injection of the predetermined amount of fuel, during cranking of the SIDI engine, based on the target combustion parameters; and a fuel actuator module that injects the predetermined amount of fuel, during cranking and while a spark plug of a cylinder is firing, based on the target combustion parameters.

2. The cold start control system of claim 1 wherein the fuel includes at least one of ethanol, methanol, liquefied petroleum gas (LPG), propane, and butane.

3. The cold start control system of claim 1 further comprising:

a stratified combustion control module that, in response to the setting of the mode to the cold start mode, determines the target combustion parameters, wherein the target combustion parameters include a distribution of injection events that is determined based on a cranking speed and an engine coolant temperature.

4. The cold start control system of claim 1 further comprising:

a mode setting module that sets the mode of operation to the cold start mode when an engine coolant temperature is less than a predetermined temperature during cranking.

5. The cold start control system of claim 4 wherein the predetermined temperature is less than a flash point temperature of fuel within a fuel tank.

6. The cold start control system of claim 4 further comprising:

a parameter determination module that determines a percentage of ethanol in fuel within a fuel tank, and wherein the mode setting module sets the predetermined temperature based on the percentage of ethanol.

7. The cold start control system of claim 1 wherein the fuel actuator module injects the predetermined amount of fuel onto the spark plug.

8. The cold start control system of claim 7 wherein the predetermined amount of fuel is injected over more than one injection event.

9. The cold start control system of claim 8 wherein an amount of fuel injected during an injection event is determined based on an amount of fuel required for a normal cold start without stratified heating.

10. A cold start control method for a vehicle having a spark ignition direct injection (SIDI) engine, comprising:

setting a mode of operation to a cold start mode;

in response to the setting of the mode to the cold start mode, determining target combustion parameters and a predetermined amount of fuel, wherein the predetermined amount of fuel is less than an amount of fuel required to initiate a combustion stroke of the SIDI engine;

controlling injection of the predetermined amount of fuel, during cranking of the SIDI engine, based on the target combustion parameters; and injecting the predetermined amount of fuel, during cranking and while a spark plug of a cylinder is firing, based on the target combustion parameters.

11. The cold start control method of claim 10 wherein the fuel includes at least one of ethanol, methanol, liquefied petroleum gas (LPG), propane, and butane.

12. The cold start control method of claim 10 further comprising:

in response to the setting of the mode to the cold start mode, determining the target combustion parameters, wherein the target combustion parameters include a distribution of injection events that is determined based on a cranking speed and an engine coolant temperature.

13. The cold start control method of claim 10 further comprising:

setting the mode of operation to the cold start mode when an engine coolant temperature is less than a predetermined temperature during cranking.

14. The cold start control method of claim 13 wherein the predetermined temperature is less than a flash point temperature of fuel within a fuel tank.

15. The cold start control method of claim 13 further comprising:

determining a percentage of ethanol in fuel within a fuel tank and setting the predetermined temperature based on the percentage of ethanol.

16. The cold start control method of claim 10 wherein the predetermined amount of fuel is injected onto the spark plug.

17. The cold start control method of claim 16 wherein the predetermined amount of fuel is injected over more than one injection event.

18. The cold start control method of claim 17 wherein an amount of fuel injected during an injection event is determined based on an amount of fuel required for a normal cold start without stratified heating.

* * * * *